US011339637B2

(12) United States Patent
Cook

(10) Patent No.: US 11,339,637 B2
(45) Date of Patent: May 24, 2022

(54) PACKAGING AND DEPLOYMENT OF A FRAC PUMP ON A FRAC PAD

(71) Applicant: FMC Technologies, Inc., Houston, TX (US)

(72) Inventor: James Cook, Houston, TX (US)

(73) Assignee: FMC TECHNOLOGIES, INC., Houston, TX (US)

( * ) Notice: Subject to any disclaimer, the term of this patent is extended or adjusted under 35 U.S.C. 154(b) by 0 days.

(21) Appl. No.: 17/104,293

(22) Filed: Nov. 25, 2020

(65) Prior Publication Data

US 2021/0156241 A1 May 27, 2021

Related U.S. Application Data

(60) Provisional application No. 62/941,446, filed on Nov. 27, 2019.

(51) Int. Cl.

| | |
|---|---|
| ***E21B 43/26*** | (2006.01) |
| ***F04B 17/00*** | (2006.01) |
| ***F04B 53/10*** | (2006.01) |
| ***F04B 23/04*** | (2006.01) |

(52) U.S. Cl.
CPC ..... *E21B 43/2607* (2020.05); *F04B 17/00* (2013.01); *F04B 23/04* (2013.01); *F04B 53/10* (2013.01)

(58) Field of Classification Search
CPC ..... E21B 43/2607; E21B 43/26; F04B 17/00; F04B 23/04; F04B 23/06; F04B 53/10; F04B 53/16
See application file for complete search history.

(56) References Cited

U.S. PATENT DOCUMENTS

| | | | | |
|---|---|---|---|---|
| 2007/0277982 | A1* | 12/2007 | Shampine | E21B 43/16 166/308.1 |
| 2009/0113888 | A1* | 5/2009 | Kuttler | F04B 1/145 60/486 |
| 2010/0119393 | A1* | 5/2010 | Osswald | F04B 23/026 417/521 |
| 2011/0272156 | A1* | 11/2011 | Johnson, Sr. | C09K 8/70 166/280.1 |
| 2012/0181046 | A1* | 7/2012 | Kajaria | E21B 43/26 166/380 |
| 2019/0234171 | A1* | 8/2019 | Witkowski | F04B 23/04 |
| 2020/0325760 | A1* | 10/2020 | Markham | E21B 43/26 |
| 2021/0048021 | A1* | 2/2021 | Hurst | E21B 43/2607 |

FOREIGN PATENT DOCUMENTS

| | | | | |
|---|---|---|---|---|
| WO | WO-2020096593 A1 * | 5/2020 | | F04B 53/001 |
| WO | WO-2021016312 A1 * | 1/2021 | | E21B 43/2607 |

* cited by examiner

*Primary Examiner* — James G Sayre
(74) *Attorney, Agent, or Firm* — Osha Bergman Watanabe & Burton LLP

(57) ABSTRACT

A modular pumping pad skid may include a base with one or more high pressure fluid conduits and one or more low pressure conduits. Additionally, two or more pumps may be removably fixed to the base, and fluidly connected to the high pressure fluid conduits and the low pressure conduits.

16 Claims, 10 Drawing Sheets

PACKAGING AND DEPLOYMENT OF A FRAC PUMP ON A FRAC PAD

BACKGROUND

Hydraulic fracturing is a stimulation treatment routinely performed on oil and gas wells in low-permeability reservoirs. Specially engineered fluids are pumped at high pressure and rate into the reservoir interval to be treated, causing a vertical fracture to open. The wings of the fracture extend away from the wellbore in opposing directions according to the natural stresses within the formation. Proppant, such as grains of sand of a particular size, is mixed with the treatment fluid to keep the fracture open when the treatment is complete. Hydraulic fracturing creates high-conductivity communication with a large area of formation and bypasses any damage that may exist in the near-wellbore area. Furthermore, hydraulic fracturing is used to increase the rate at which fluids, such as petroleum, water, or natural gas can be recovered from subterranean natural reservoirs. Reservoirs are typically porous sandstones, limestones or dolomite rocks, but also include "unconventional reservoirs" such as shale rock or coal beds. Hydraulic fracturing enables the extraction of natural gas and oil from rock formations deep below the earth's surface (e.g., generally 2,000-6,000 m (5,000-20,000 ft)), which is greatly below typical groundwater reservoir levels. At such depth, there may be insufficient permeability or reservoir pressure to allow natural gas and oil to flow from the rock into the wellbore at high economic return. Thus, creating conductive fractures in the rock is instrumental in extraction from naturally impermeable shale reservoirs.

A wide variety of hydraulic fracturing equipment is used in oil and natural gas fields, such as a slurry blender, one or more high-pressure, high-volume fracturing pumps and a monitoring unit. Additionally, associated equipment includes fracturing tanks, one or more units for storage and handling of proppant, high-pressure treating iron, a chemical additive unit (used to accurately monitor chemical addition), low-pressure flexible hoses, and many gauges and meters for flow rate, fluid density, and treating pressure. Fracturing equipment operates over a range of pressures and injection rates, and can reach up to 100 megapascals (15,000 psi) and 265 liters per second (9.4 cu ft/s) (100 barrels per minute).

As seen in FIG. 1, FIG. 1 illustrates an example of an existing hydraulic fracturing pad system 100 (often referred to as a "frac pad" in the industry). The fracturing pad system 100 includes at least one pump truck 102 connected to a missile manifold 104 via fluid connections 106. Additionally, a blending system 108 may be connected to the pump trucks 102 through one or more hoses 110 to supply proppant and other particulates to the pump trucks 102 to pump into the well (through wellheads W) as part of the fracturing process. The missile manifold 104 may be connected to a valve structure 112 that, for instance, can include a safety valve that may open to relieve pressure in the system under certain conditions. The valve structure 112 may be connected to at least one manifold 114 through a pipe spool 116 that is a plurality of pipes flanged together, for instance. As can be seen from FIG. 1, the fracturing pad system 100 includes many, non-uniform connections that must be made up and pressure tested, including the conduits to/from the pump trucks 102, missile trailer 104, and blending system 108. Furthermore, the connections between the missile manifold 104 and valve structure 112, and the pipe spool 116 between the valve structure 112 and the manifolds 114 are also non-uniform connections that must be made up and pressure tested. These connections take valuable time and resources on site. Additionally, the fracturing pad system 100 is generally not flexible regarding the number of pumps that can be used.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a modular pumping pad skid. The modular pumping pad skid may include a base with one or more high pressure fluid conduits and one or more low pressure conduits. Additionally, two or more pumps may be removably fixed to the base, and fluidly connected to the high pressure fluid conduits and the low pressure conduits.

In other aspects, the embodiments disclosed herein relate to a system with one or more modular pumping pad skids. The one or more modular pumping pad skids may include: one or more high pressure fluid conduits within a base; one or more low pressure conduits within the base; and one or more pumps removably fixed to the base. The pumps may be fluidly connected to the high pressure fluid conduits and the low pressure conduits. Additionally, one or more power sources may be fluidly coupled to the one or more pumps, and the one or more power sources is configured to power the one or more pumps. A fluid manifold may be coupled to a well, and the one or more pumps is fluidly coupled to the fluid manifold. Further, the one or more pumps are configured to inject fluids into the well.

In yet another aspect, the embodiments disclosed herein relate to a method that may include powering a pump on a modular pumping pad skid with a power source via a hydraulic pressure conduit fluidly coupled to the pump; flowing a fluid through a low pressure conduit of the modular pumping pad skid; directing the fluid from the low pressure conduit to the pump; flowing the fluid from the pump to a high pressure fluid conduit; and injecting the fluid into a well via a fluid manifold fluidly coupled to the high pressure fluid conduit.

Other aspects and advantages will be apparent from the following description and the appended claims.

DETAILED DESCRIPTION

Figure 1:
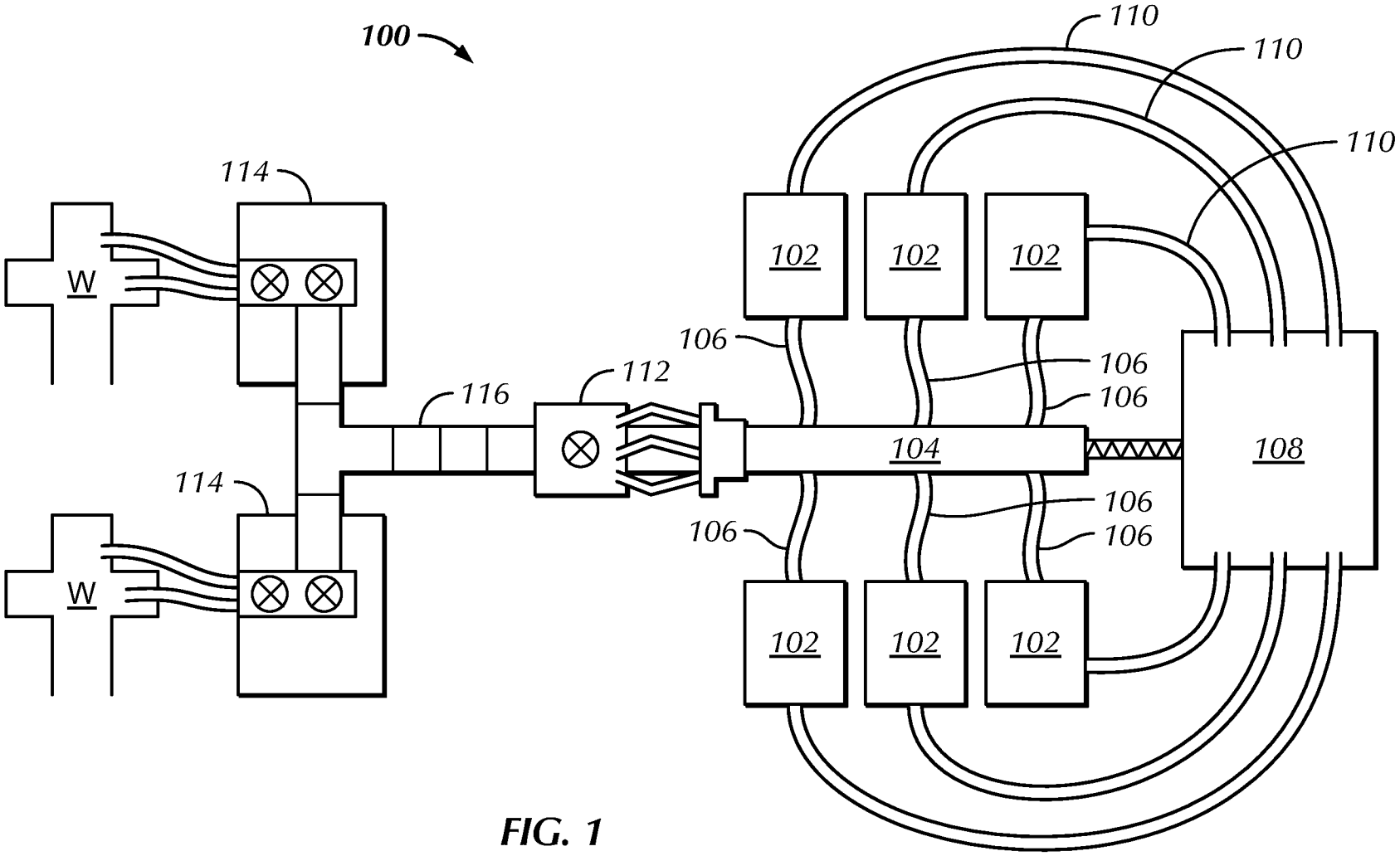
FIG. 1 (Prior Art)
FIG. 1 is a block diagram of an example of a conventional hydraulic fracturing pad system.

In one aspect, embodiments disclosed herein relate to a modular fracturing pump pad system. The modular fracturing pump pad system may also be interchangeably referred to as a modular pump skid system in the present disclosure. As used herein, the term "coupled" or "coupled to" or "connected" or "connected to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification.

A modular pump skid system, according to embodiments herein, is a system in which the elements of fracturing pumps are modularized and deployed on connectable modular skids that can be secured together to a well site to form an interchangeable fracturing pump. The modular pump skid system elements are modularized in a way such that the conduit manifolds/flow functionality is made up when the modular pump skid systems are connected. Further, the modular pump skid system elements may be held on units having standardized uniform connections, such that different types of pump element units may be connected together using the same connection type. The reduction of using non-uniform connections that must be made up and pressure tested may significantly reduce the complexity, design, time, and weight of the system. Additionally, the modular pump skid system may be used to direct fluid produced from or injected into a well.

In some embodiments, a modular pump skid may be loaded onto a base and connected to other modular pump skids. In such embodiments, the base holding various components of the fracturing pump may be transported to a wellsite such that the equipment on the base (e.g., fluid conduits, pumps, valve manifolds, etc.) may all be pre-rigged and dropped on location in rigged-up condition. By using modular pump skids according to embodiments of the present disclosure for hydraulic fracturing wellbore operations, equipment may be pre-rigged and dropped on location in any condition, including ready-to-use, thereby reducing installation time in the field. According to embodiments of the present disclosure, a modular fracturing pump skid may include piping or a body having one or more flow paths formed therethrough to interconnect with other pumps skids or a fluid manifold. As used herein, fluids may refer to proppant, frac fluids, liquids, gases, and/or mixtures thereof. Other instruments and devices, including without limitation, sensors and various valves may be incorporated within a modular fracturing pump pad system.

Conventional fracturing pumps in the oil and gas industry typically consume a large amount of space and resources of a rig area. Conventional fracturing pumps may use elements that are individually designed and sized with pipes, flow lines, diesel engines, and other conduits being used to interconnect the conventional fracturing pumps to fracturing operations. Furthermore, pipes, flow lines, and other conduits being used to interconnect the conventional fracturing pumps are not uniform and take valuable time to make up and pressure test. Additionally, the sheer number of pipes, hoses, and other fluid connections represent safety hazards for on-site workers. This additional components needed to interconnect the conventional fracturing pumps adds to the weight, installation costs, and overall cost of the conventional fracturing pumps. However, using modular pump skids according to one or more embodiments of the present disclosure may overcome such challenges, as well as provide additional advantages over conventional fracturing pumps.

Figure 2A:
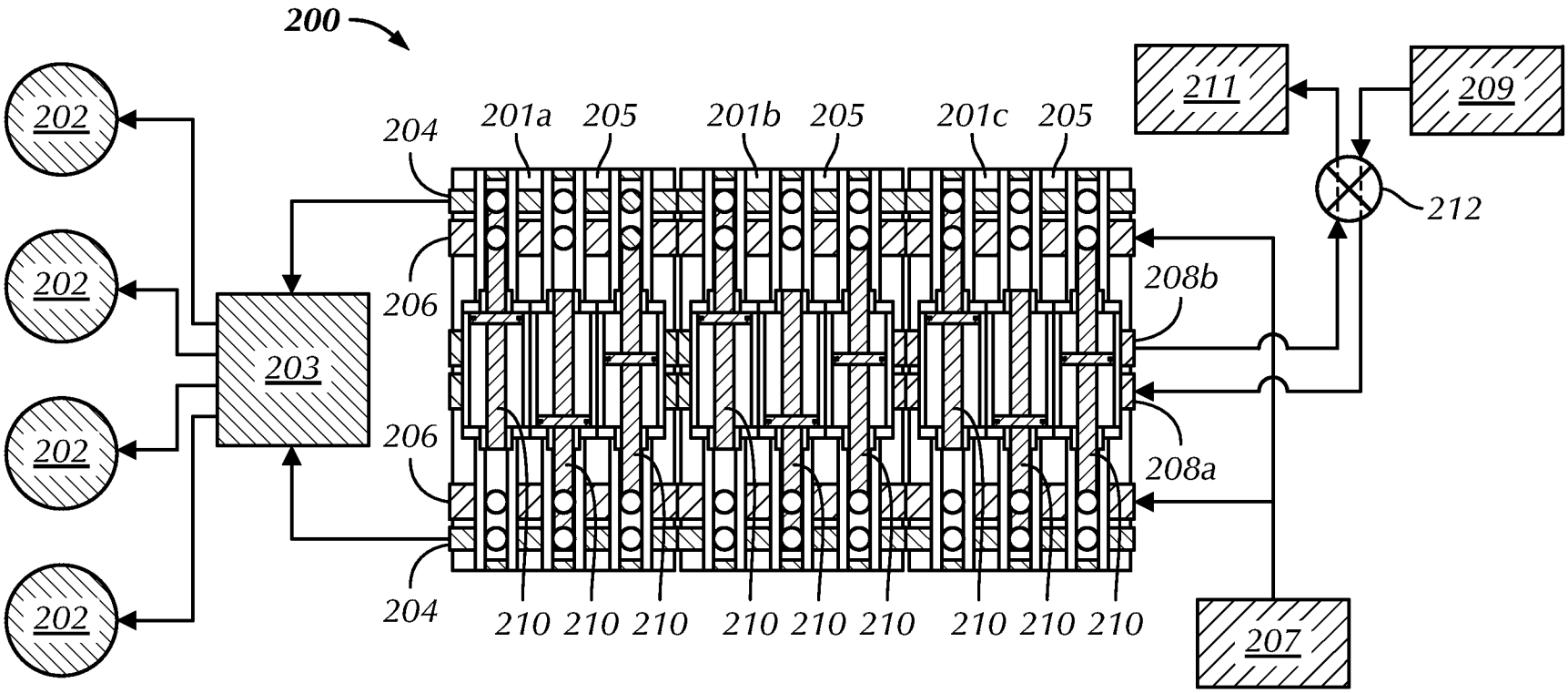
FIG. 2A illustrates a view of a modular fracturing pump pad system in accordance with one or more embodiments of the present disclosure.

Referring to FIG. 2A, in one or more embodiments, FIG. 2A illustrates a modular pump skid system 200. The modular pump skid system 200 may include one or more modular pump skids (201*a*, 201*b*, 201*c*) with one or more pumps 210 disposed on a base 205. While it is noted that three modular pumps skids are shown, this is merely for example purposes only and any number of modular pump skids may be used without departing from the scope of the present disclosure. Further, any number of pumps 210 may be disposed on the base 205. Additionally, the pumps 210 may each be a hydraulic pump. The modular pump skids (201*a*, 201*b*, 201*c*) may be coupled to at least one wellhead 202 by using manifold skid 203. The manifold skid 203, in some embodiments, refers to a modular skid that is purpose built for connection to a wellhead, which may include an outlet head (which may be referred to as a fracturing head or goat head in fracturing operations) for connection to the wellhead and one or more gate valves. Additionally, high-pressure fluid conduits 204 of each modular pump skids (201*a*, 201*b*, 201*c*) are in fluid communication with the manifold skid 203. For example, the high-pressure fluid conduits 204 may inject or receive fluids from the manifold skid 203. Each high-pressure fluid conduit 204 may be integrated with the base 205 of the modular pump skids (201*a*, 201*b*, 201*c*). Additionally, low-pressure fluid conduits 206 may also be integrated with the base 205. For example, a frac blender 207 may feed fluids into modular pump skid system 200 through the low-pressure fluid conduits 206. It is further envisioned that one or more fluid conduits (208*a*, 208*b*) may also be integrated with the base 205. For example, a hydraulic pressure conduit 208*a* may be in fluid communication with a power source 209, such as a turbine, to direct drive the pumps 210 on each modular pump skid (201*a*, 201*b*, 201*c*). Further, a hydraulic excess conduit 208*b* may be integrated into the base 205 to allow for any excess fluids from the power source 209 to be disposed into a hydraulic fluid tank 211. A relief valve 212 may also be installed in the lines between the hydraulic power source 209 and the hydraulic fluid tank 211.

Figure 2B:
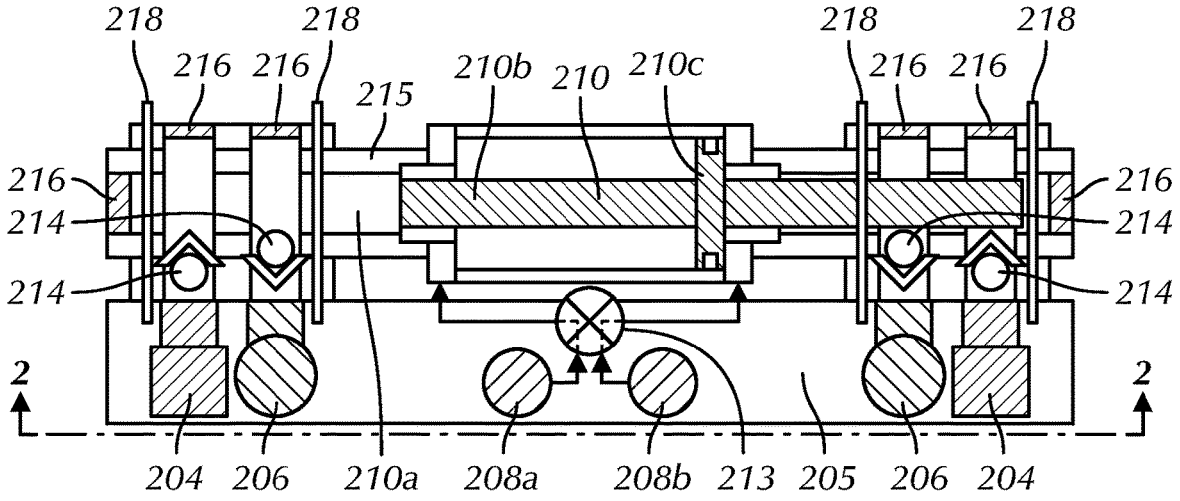
FIGS. 2B and 2C illustrate views of a modular fracturing pump pad system of FIG. 2A in accordance with one or more embodiments of the present disclosure.

In some embodiments, each modular pump skid (201*a*, 201*b*, 201*c*) may be placed adjacent to each other such that the fluid conduits (204, 206, 208*a*, 208*b*) and pumps 210 of each modular pump skid (201*a*, 201*b*, 201*c*) are in fluid communication. As shown in FIG. 2B, a side of the modular pump skids (201*a*, 201*b*, 201*c*) illustrates that a control valve 213 may be used to control the fluids between the pumps 210, the hydraulic pressure conduit 208*a*, and the hydraulic excess conduit 208*b*. In one or more embodiments, the pumps 210 may each be a hydraulic pump with a plunger 210*b* and piston 201*c*. Additionally, each pump 210 may include a plurality of check valves 214 to control a fluid exiting and entering the high-pressure fluid conduits 204 and the low-pressure fluid conduits 206 from the pumps 210. It is further envisioned that openings of a body 215 of each of the pumps 210 may be sealed by removable caps 216. One skilled in the art will appreciate how the removable caps 216 may be removed to access the internal components of each of the pumps 210. It is further envisioned that through studs or bolts 218 may be used to removable fix each of the pumps 210 to the base 205

Figure 2C:
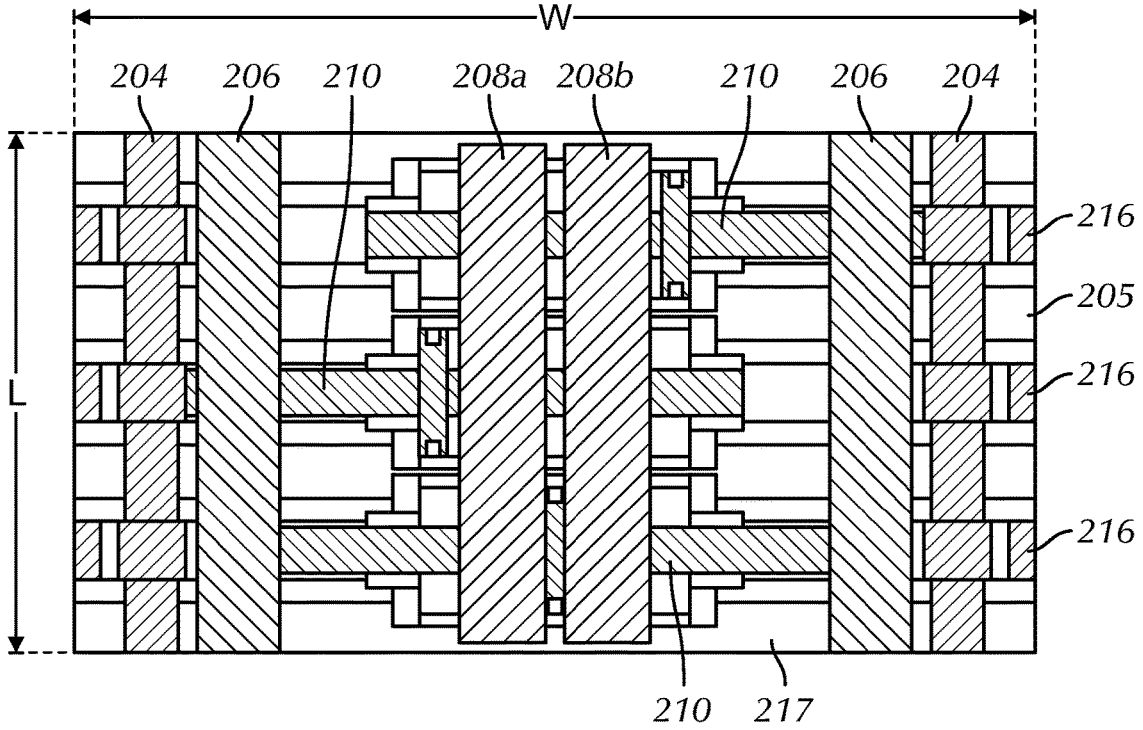

Referring to FIG. 2C, FIG. 2C illustrates a bottom view of the pumps 210 taken along line 2-2 in FIG. 2B. In some embodiments, the high-pressure fluid conduits 204, the low-pressure fluid conduits 206, the hydraulic pressure conduit 208*a*, and the hydraulic excess conduit 208*b* extend a length L of the base 205. The length L may extend a full length of the base 205 such that the integrated conduits (204, 206, 208*a*, 208*b*) may open flush to an outer surface 217 of the base 205. Additionally, each pump 210 may extend a width W of base 205 such that the removable caps 216 seal ends of the pumps 210.

Figure 3:
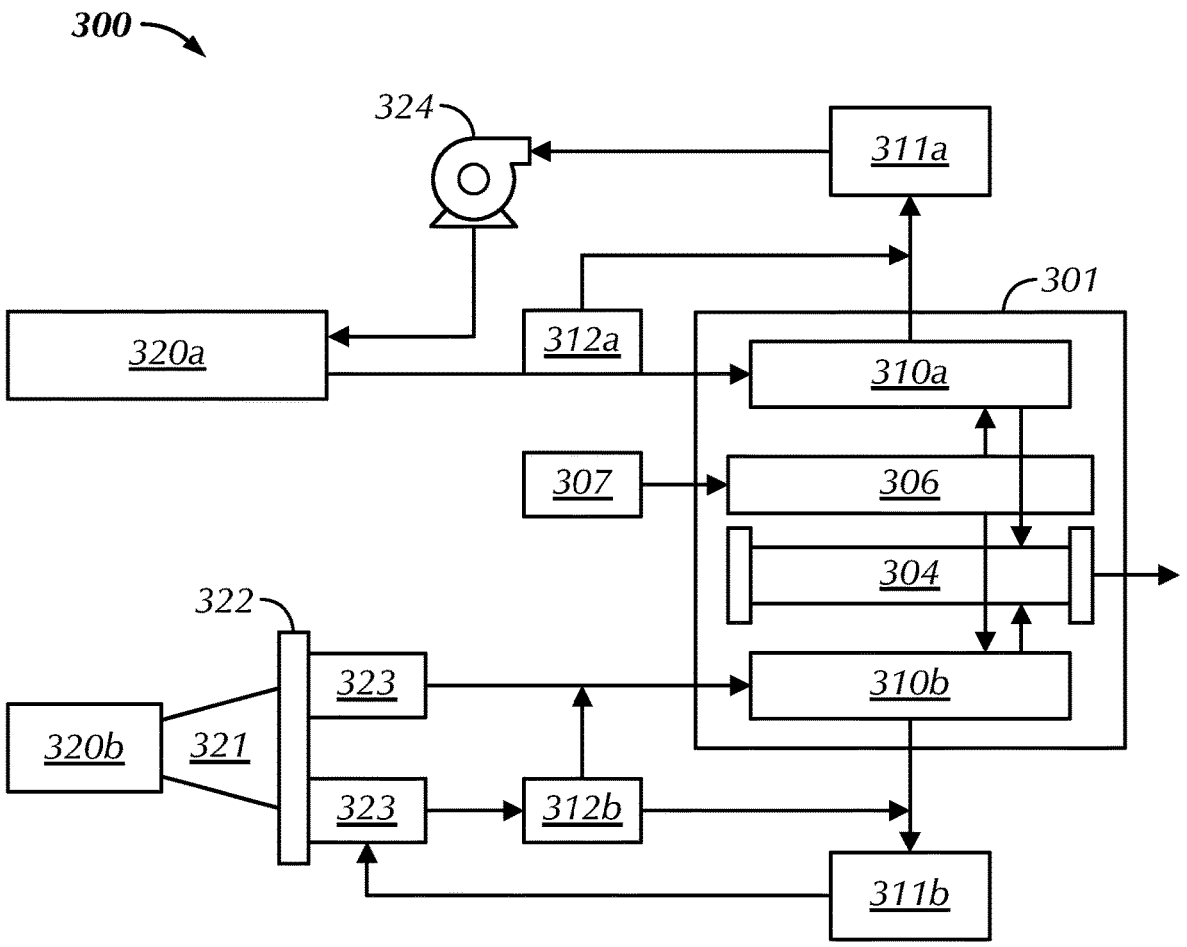
FIG. 3 illustrates a view of a modular fracturing pump pad system in accordance with one or more embodiments of the present disclosure.

Now referring to FIG. 3, in one or more embodiments, FIG. 3 illustrates a schematic flow diagram of a modular pump skid 301 in a modular pump skid system 300. The modular pump skid 301 may include a first pump 310*a*, a second pump 310*b*, a high-pressure fluid conduit 304, and a low-pressure fluid conduit 306. One skilled in the art will appreciate how modular pump skid 301 may be powered via various power sources. In a non-limiting example, a first fluid prime mover 320*a* may be fluidly connected to and power the first pump 310*a*. A second fluid prime mover 320*b* may be fluidly connected to and power the second pump 310*b*. While it is noted that two power sources are shown in FIG. 3, this is merely for example purposes only and any number of power sources may be used without departing from the scope of the present disclosure. In some embodiments, the first fluid prime mover 320*a* may power both the pumps 310*a*, 310*b* without the second fluid prime mover 320*b*. Additionally, the second fluid prime mover 320*b* may power both the pumps 310*a*, 310*b* without the first fluid prime mover 320*a*. Further, in some embodiments, each pump 310*a*, 310*b* may have an individual power source or share a power source of any type of primer. It is further envisioned that the first fluid prime mover 320*a* may be a plunger pump and the second fluid prime mover 320*b* may be a gas turbine. The second fluid prime mover 320*b* may additionally have a gear reducer 321, a pump drive gearbox 322, and pumps 323.

As shown in FIG. 3, the first fluid prime mover 320*a* may provide hydraulic pressure (e.g., 3-5 k PSI) to the first pump 310*a*. Additionally, any excess hydraulic pressure may be bled off from the first pump 310*a* to a first hydraulic fluid tank 311*a*. From the first hydraulic fluid tank 311, the excess hydraulic pressure is then feed to a boost pump 324 to redirect the excess hydraulic pressure into the first fluid prime mover 320*a* for recirculation. A first relief valve 312*a* may be provide on fluid lines from the first pump 310*a* to first fluid prime mover 320*a* and the hydraulic fluid tank 311. Likewise, the second fluid prime mover 320*b* may provide hydraulic pressure (e.g., 3-5 k PSI) to the second pump 310*b*. Additionally, any excess hydraulic pressure may be bled off from the second pump 310*b* to a second hydraulic fluid tank 311*b*. From the hydraulic fluid tank 311, the excess hydraulic pressure is then feed to the pumps 323 to redirect the excess hydraulic pressure into the second fluid prime mover 320*b* for recirculation.

In one or more embodiments, a frac blender 307 may provide hydraulic blended pressure (e.g., 100-120 PSI) to the low-pressure fluid conduit 306, which may then be distributed to the first pump 310*a* and the second pump 310*b*. From the first pump 310*a* and the second pump 310*b*, a treated pressure (e.g., 15 k PSI) may exit the modular pump skid 301 through the high-pressure fluid conduit 304.

Figure 4:
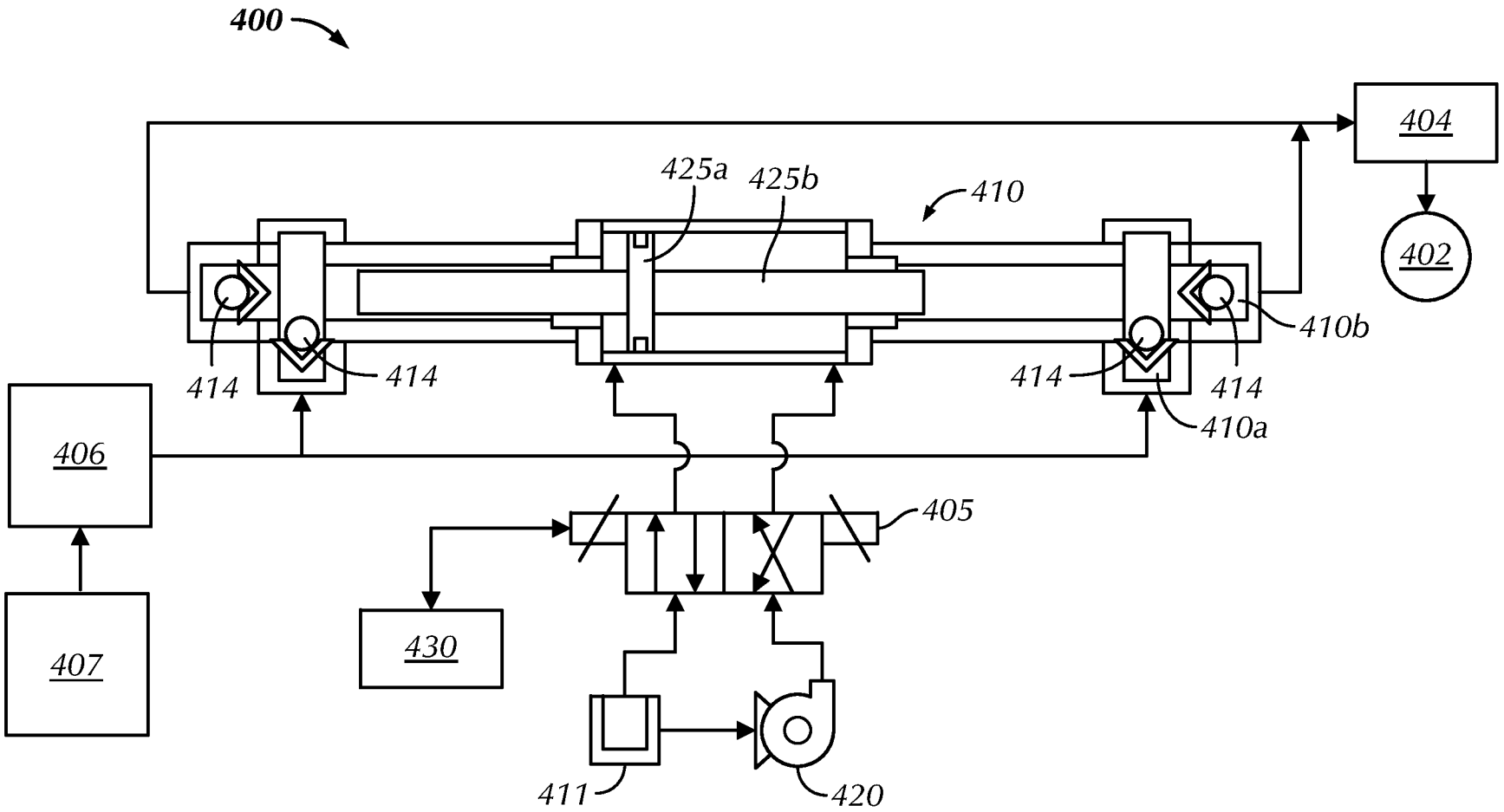
FIGS. 4-8B illustrate views of a modular fracturing pump pad system in accordance with one or more embodiments of the present disclosure.

Now referring to FIG. 4, in one or more embodiments, FIG. 4 illustrates a schematic diagram of a pump 410 in a modular pump skid system 400. In a non-limiting example, the pump 410 may be a dual acting hydraulic pump having an inlet 410*a* fluidly coupled to a low-pressure fluid conduit 406 and an outlet 410*b* fluidly coupled to a high-pressure fluid conduit 404. The high-pressure fluid conduit 404 may be fluidly coupled to a wellhead 402 and the low-pressure fluid conduit 406 may be fluidly coupled to a frac blender 407. Further, both the inlet 410*a* and the outlet 410*b* may have a check valve 414 for control of fluid flow. Additionally, the pump 410 may have a piston 425*a* and plunger 425*b* configuration. It is further envisioned that a base 405 may incorporate a control valve and have a control system 430 to operate the pump 410. In some embodiments, a fluid prime mover 420 (e.g., a turbine) may be fluidly coupled to the base 405 to power the pump 410. Additionally, a tank 411 may be fluidly coupled to the base 405 to recirculate excess hydraulic pressure from the fluid prime mover 420.

Figure 5A:
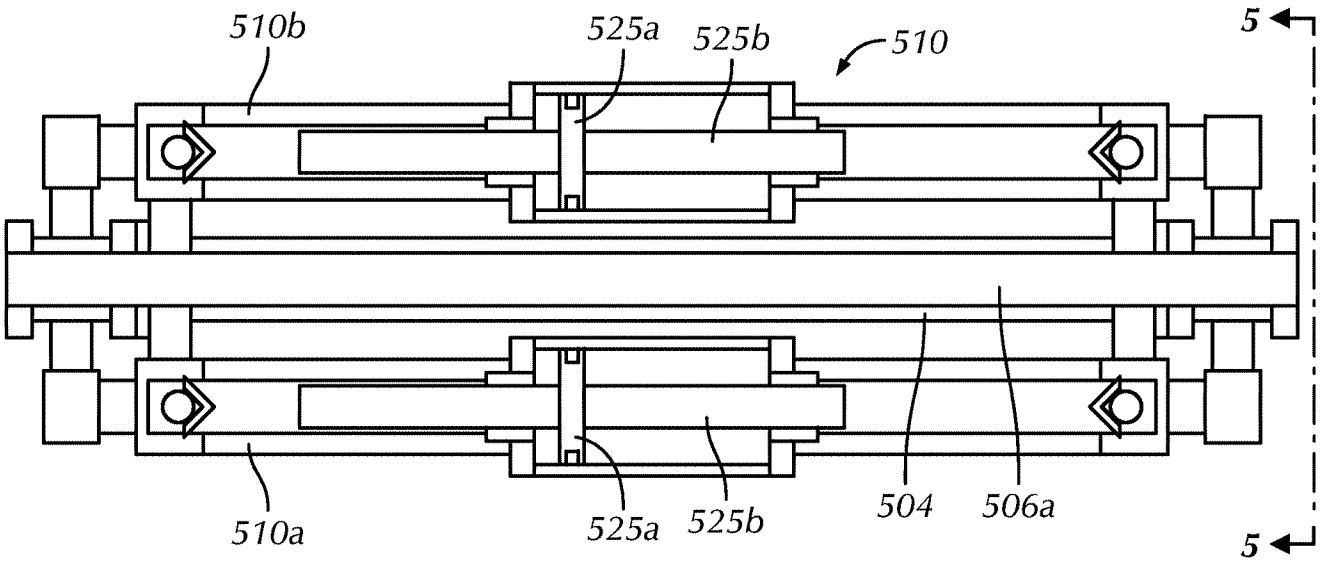
Figure 5B:
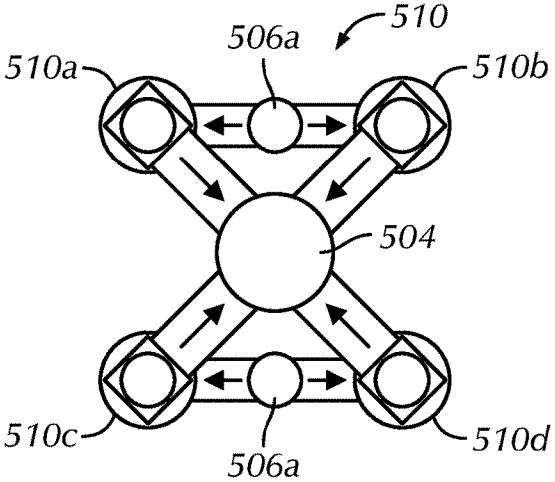

Now referring to FIGS. 5A and 5B, in one or more embodiments, FIGS. 5A and 5B illustrate a schematic diagram of a pump 510 for a modular pump skid. FIG. 5A shows a top view while FIG. 5B shows a side view taken along line 5-5 in FIG. 5A. As shown in FIGS. 5A and 5B, the pump 510 may include four hydraulic pumps (510*a-d*) with a piston 525*a* and plunger 525*b* configuration. In such an arrangement, the pump 510 may have a first low-pressure fluid conduit 506*a* fluidly coupled to two of the four hydraulic pumps (510*a-b*) and a second low-pressure fluid conduit 506*b* fluidly coupled to the other two of the four hydraulic pumps (510*c-d*). It is further envisioned that a singular high-pressure fluid conduit 504 may be fluidly coupled to ends of the four hydraulic pumps (510*a-d*).

Figure 6:
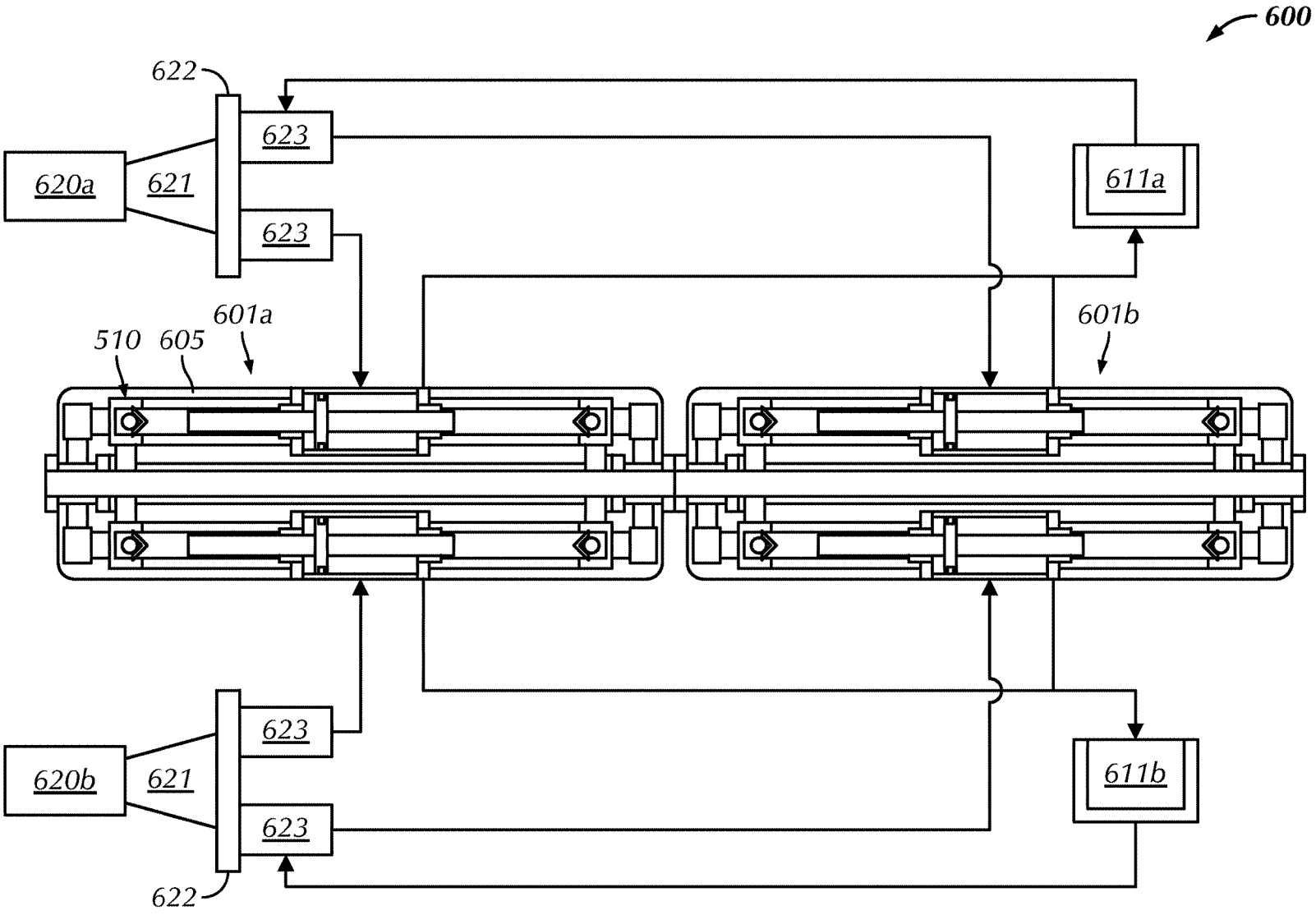

Now referring to FIG. 6, in one or more embodiments, FIG. 6 shows the pump 510 of FIG. 5 on a base 605 of a first modular pump skid 601*a* in a modular pump skid system 600. Additionally, a second modular pump skid 601*b* may be fluidly coupled to the first modular pump skid 601*a* and have the same configuration of the pump 510. As further shown in FIG. 6, a first fluid prime mover 620*a*, such as a turbine, may provide hydraulic pressure to the first modular pump skid 601*a* and the second modular pump skid 601*b* through a gear reducer 621, a pump drive gearbox 622, and pumps 623. Additionally, any excess hydraulic pressure from the second fluid prime mover 620*a* may be bled off from the first modular pump skid 601*a* and the second modular pump skid 601*b* to a first hydraulic fluid tank 611*a*. From the first hydraulic fluid tank 611*a*, the excess hydraulic pressure is then redirected into the first fluid prime mover 620*a* for recirculation. It is further envisioned that a second fluid prime mover 620*b* may also be used to provide additional or back-up hydraulic pressure to the first modular pump skid 601*a* and the second modular pump skid 601*b* through a gear reducer 621, a pump drive gearbox 622, and pumps 623. Further, any excess hydraulic pressure from the second fluid prime mover 620*b* may be bled off from the first modular pump skid 601*a* and the second modular pump skid 601*b* to a second hydraulic fluid tank 611*b*. From the second hydraulic fluid tank 611*b*, the excess hydraulic pressure is then redirected into the second fluid prime mover 620*b* for recirculation.

Figure 7A:
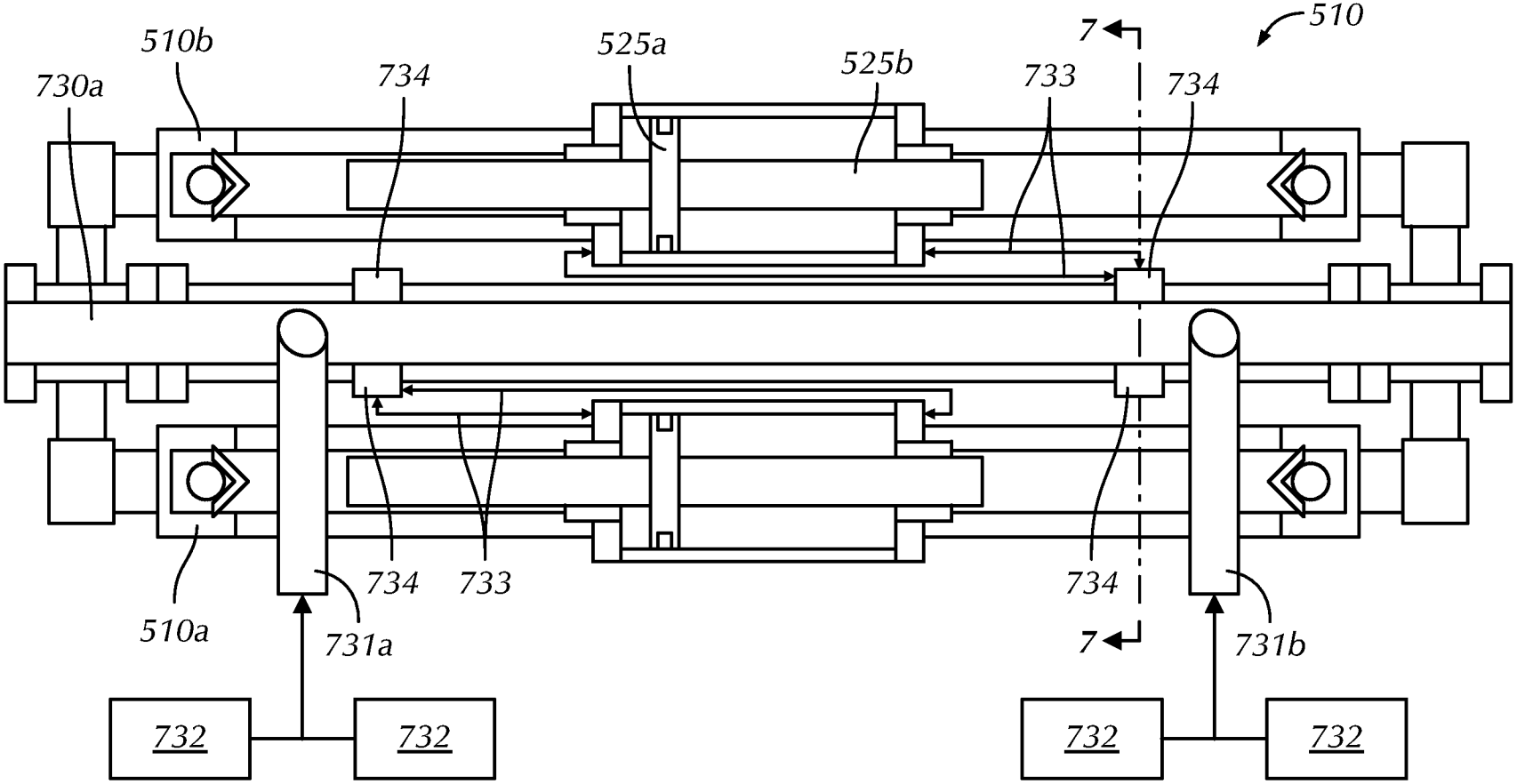
Figure 7B:
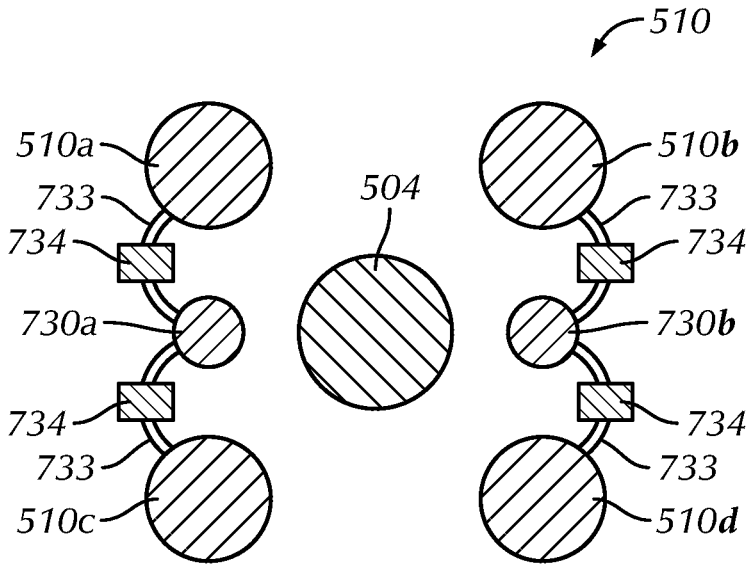

Referring now to FIGS. 7A and 7B, another embodiment of a pump assembly according to embodiments herein is illustrated, where like numerals represent like parts. The embodiment of FIGS. 7A and 7B is similar to that of the embodiment of FIGS. 5A and 5B. However, in place of two low-pressure fluid conduits (see 506*a-b* in FIGS. 5A and 5B), the pump 510 of FIGS. 7A and 7B includes a first prime mover fluid distribution conduit 730*a* and a second prime mover fluid distribution conduit 730*b*. Each prime mover fluid distribution conduit (730*a*, 730*b*) may include, for example, two flow lines 731*a*, 731*b* fluidly coupled to prime mover pumps 732. Additionally, flow lines 733 fluidly connect the first prime mover fluid distribution conduit 730*a* and the second prime mover fluid distribution conduit 730*b* to the respective hydraulic pump (510*a-d*). Further, each of the flow lines 733 may have a control valve 734 to control flow rates.

Figure 8A:
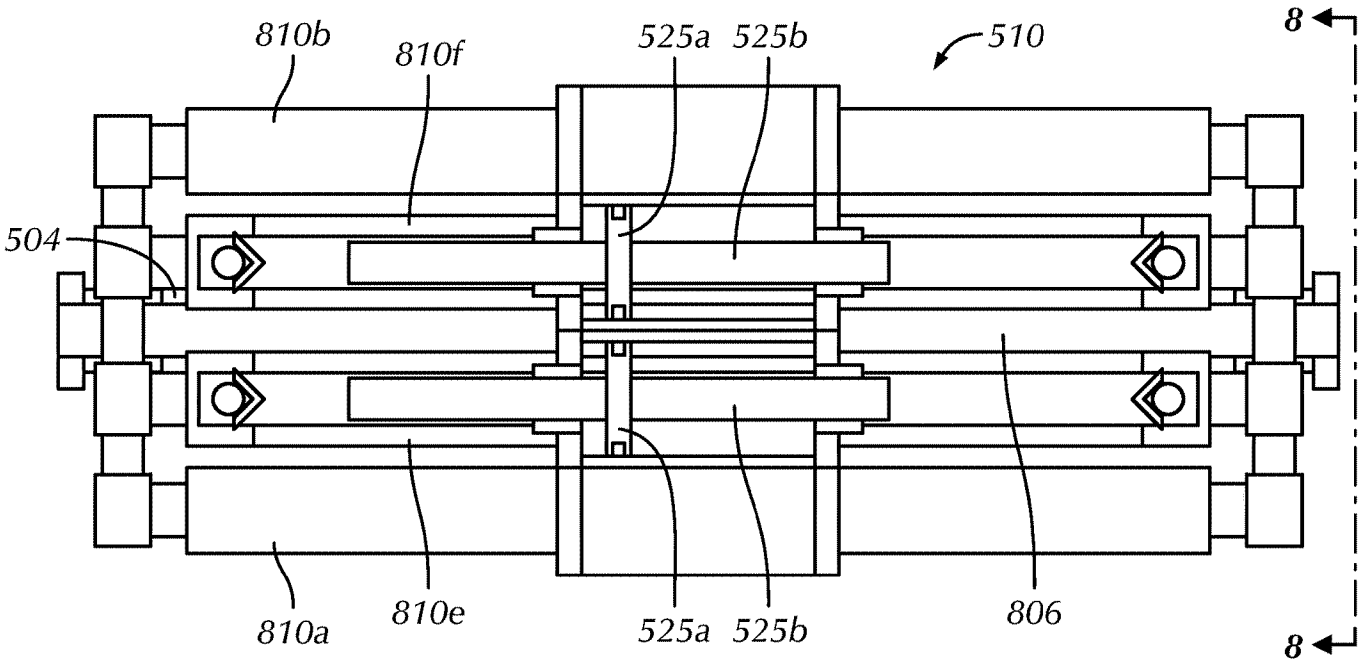
Figure 8B:
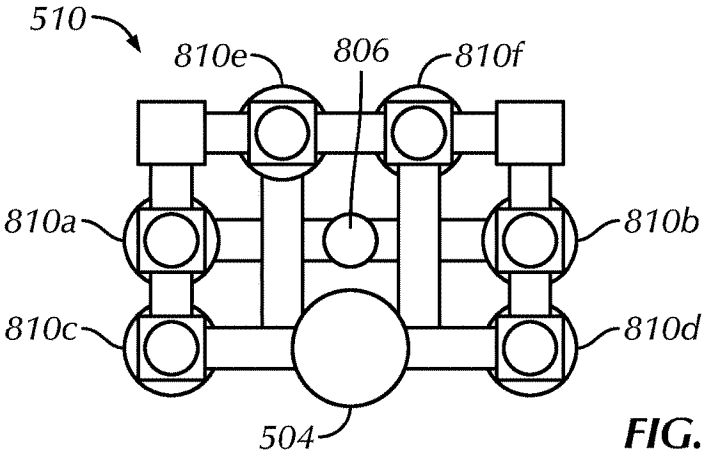

Referring now to FIGS. 8A and 8B, another embodiment of a pump assembly according to embodiments herein is illustrated, where like numerals represent like parts. The embodiment of FIGS. 8A and 8B is similar to that of the embodiment of FIGS. 5A and 5B. However, instead two low-pressure fluid conduits (see 506*a-b* in FIGS. 5A and 5B), the pump 510 of FIGS. 7A and 7B only has one low-pressure fluid conduit 806 and includes six hydraulic pumps 810*a-f* instead of four hydraulic pumps (see 510*a-d* in FIGS. 5A and 5B).

According to embodiments of the present disclosure, the modular pump skid systems may be configured to a pressure rating of any job requirement. Specifically, a main pressure rating limitation of the modular pump skid system may correspond with the wellheads, as known in the art. Furthermore, the modular pump skid systems may be rated up to 15,000 psi, but is not limited to 15,000 psi (in some cases the pressure rating may go up to 20,000 psi or more). One skilled in the art will appreciate how various equipment of within the modular pump skid system may have different pressure ratings. For example, each of the pumps may have a pressure rating of 15,000 psi while the wellheads and the manifold skid may have a pressure rating of 10,000 psi. In some embodiments, the pumps of the modular pump skid system may be pressure rated higher than the wellheads and the manifold skid, which may have pressures ratings from 5,000 psi up to 15000 psi, for example, and can change from job to job.

According to embodiments of the present disclosure, fluid conduits of the modular pump skid system may have an inner diameter ranging from, for example, 4 inches to 8 inches. One skilled in the art will appreciate how the fluid conduits is not limited to the range of 4 inches to 8 inches and may be any desired inner diameter based on the job requirements. As such, the fluid conduits may be as small as ¾ inch (i.e., a 1 inch flow line) or as large as 30 inches (API 6A has regulations up to a 30 inch ID, 3000 PSI capacity). In such a case, the ends of the fluid conduits may have an upset section to transition from a larger inner diameter at the ends to a smaller inner diameter.

In one or more embodiments, the modular pump skid systems may be deployed in at least two ways. In a first way, modular pump skid system may be loaded onto a truck and unloaded on site via a crane, for instance. Once unloaded, the modular pump skid systems can be placed in proximity to one another and secured together, such as by bolts and/or hydraulics, to form a unitary pump structure. The end portions (inlet(s) and outlet(s)) of fluid conduits of the modular pump skid system may be connected together by any known mechanisms, including flanges, clamps, grayloc hubs, KL4 connectors, etc. In some embodiments, modular pump skid systems may be mounted and deployed on flatbeds. The fluid conduit connections between multiple modular pump skid systems on a truck may be made up before the trucks are driven to the site. In a non-limiting example, the modular pump skid system may be modularized and deployed on connectable skids to reduce the number of connections to other equipment. Additionally, a size of the modular pump skid system (including the size of modular skid footprints, modular skid heights, equipment configurations arranged on the modular skids, etc.) may be selected based, for instance, on the size limitations of common transportation means, Department of Transportation (DOT) requirements (e.g., to meet weight and size limits of loads being transported on roads by trailers or trucks), the type of function each modular skid is to perform, and/or to provide reduced cost and reduced time to manufacture. Overall, a modular pump skid system according to embodiments of the present disclosure may minimize product engineering, risk associated with non-uniform connections, reduction of assembly time, hardware cost reduction, and weight and envelope reduction.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A modular pumping pad skid, comprising:

a base, wherein the base comprises:

one or more high pressure fluid conduits;

one or more low pressure conduits;

two or more pumps removably fixed to the base, wherein the pumps are fluidly connected to the high pressure fluid conduits and the low pressure conduits, wherein the two or more pumps comprise hydraulic pumps, and wherein the base further comprises a hydraulic pressure conduit and a hydraulic excess conduit; and wherein the hydraulic pumps are fluidly connected to the hydraulic pressure conduit and the hydraulic excess conduit.

2. The modular pumping pad skid of claim 1, wherein each of the hydraulic pumps comprises a plunger, a piston, and at least one check valve.

3. The modular pumping pad skid of claim 1, wherein the base comprises a control system configured to operate the modular pumping pad skid.

4. The modular pumping pad skid of claim 1, wherein openings of a body of the two or more pumps are sealed with a removable cap.

5. The modular pumping pad skid of claim 1, wherein the two or more pumps are removably fixed to the base via through studs or bolts.

6. A system comprising:

one or more modular pumping pad skids, comprising:

one or more high pressure fluid conduits within a base;

one or more low pressure conduits within the base; and one or more pumps removably fixed to the base, wherein the pumps are fluidly connected the high pressure fluid conduits and the low pressure conduits, and wherein the base further comprises a hydraulic pressure conduit and a hydraulic excess conduit; and wherein the one or more pumps are fluidly connected to the hydraulic pressure conduit and the hydraulic excess conduit;

one or more power sources fluidly coupled to the one or more pumps, wherein the one or more power sources is configured to power the one or more pumps; and a fluid manifold coupled to a well, wherein the one or more pumps is fluidly coupled to the fluid manifold, wherein the one or more pumps are configured to inject fluids into the well.

7. The system of claim 6, further comprising at least two modular pumping pad skids of the one or more modular pumping pad skids fluidly coupled together.

8. The system of claim 7, wherein the high pressure fluid conduits, the low pressure fluid conduits, the hydraulic pressure conduit, and the hydraulic excess conduit of a first modular pumping pad skids of the at least two modular pumping pad skids is fluidly connected to a corresponding high pressure fluid conduits, low pressure fluid conduits, hydraulic pressure conduit, and hydraulic excess conduit of a second modular pumping pad skids of the at least two modular pumping pad skids.

9. The system of claim 6, further comprising a hydraulic excess tank fluidly coupled to the hydraulic excess conduit.

10. The system of claim 9, further comprising a relief disposed between the hydraulic excess tank and the hydraulic power sources.

11. The system of claim 6, further comprising a frac blender fluidly coupled to the low pressure conduits.

12. The system of claim 6, wherein the one or more power sources are a hydraulic turbine configured to direct drive the one or more pumps.

13. A method for using a modular pumping pad skid, the method comprising:

powering a pump on a modular pumping pad skid with a power source via a hydraulic pressure conduit, in a base of the modular pumping pad skid, fluidly coupled to the pump;

flowing a fluid through a low pressure conduit of the modular pumping pad skid;

directing the fluid from the low pressure conduit to the pump;

flowing the fluid from the pump to a high pressure fluid conduit;

injecting the fluid into a well via a fluid manifold fluidly coupled to the high pressure fluid conduit; and redirecting excess hydraulic pressure through a hydraulic excess conduit, in the base of the modular pumping pad skid, and into a hydraulic excess tank.

14. The method of claim 13, further comprising recirculating the excess hydraulic pressure from the hydraulic excess tank to the power source.

15. The method of claim 13, wherein directing the fluid through the pump comprises activating a check valve within the pump.

16. The method of claim 13, further comprising controlling the modular pumping pad skid with a control system within the base of the modular pumping pad skid.

* * * * *